US005975037A

United States Patent [19]

Korostenski et al.

[11] Patent Number: 5,975,037

[45] **Date of Patent: *Nov. 2, 1999**

[54] INTERNAL COMBUSTION ENGINE

[76] Inventors: Erwin Korostenski, Heilbronner Str. 8, D-74172 Neckarsulm; Armin Bertsch, Mutbrunnengasse 9, D-74196 Neuenstadt; Reiner Walter, Heilbronner Str. 6, D-74172 Neckarsulm, all of Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/875,631

[22] PCT Filed: Jan. 17, 1996

[86] PCT No.: PCT/DE96/00054

§ 371 Date: Jul. 30, 1997

§ 102(e) Date: Jul. 30, 1997

[87] PCT Pub. No.: WO96/23963

PCT Pub. Date: Aug. 8, 1996

[30] Foreign Application Priority Data

Jan. 30, 1995 [DE] Germany ..... 195 39 901

[51] Int. Cl.[6] ..... F01L 1/356

[52] U.S. Cl. ..... 123/90.17; 123/90.6

[58] Field of Search ..... 123/90.15, 90.17, 123/90.31, 90.6; 74/568 R

[56] References Cited

U.S. PATENT DOCUMENTS

| | | | |
|---|---|---|---|
| 5,333,579 | 8/1994 | Hara et al. | 123/90.17 |
| 5,494,009 | 2/1996 | Yamada et al. | 123/90.17 |
| 5,557,983 | 9/1996 | Hara et al. | 123/90.17 |

FOREIGN PATENT DOCUMENTS

| | | |
|---|---|---|
| 0 179 581 | 4/1986 | European Pat. Off. . |
| 1311562 | 3/1973 | United Kingdom . |

OTHER PUBLICATIONS

Patent Abstracts of Japan vol. 17, No. 486 (M–1473) Sep. 3, 1993.

Patent Abstracts of Japan JP A,05 118208 (Shigeru Kawakami) May 14, 1993.

*Primary Examiner*—Weilun Lo

*Attorney, Agent, or Firm*—Edward M. Livingston, Esq.

[57] ABSTRACT

An internal combustion engine with a device for cyclically varying the speed of rotation of a cam for gas exchange control comprises a shaft (1) and an axis of rotation (5), a rotary body (2) rotatably supported on said shaft (1), wherein the speed of rotation of the rotary body (2) corresponds to the speed of rotation of the cam, and an intermediate member (4) rotatably supported in a plane perpendicular to said axis of rotation (5) of said shaft (1), wherein said rotary body (2) is rotated cyclically in relation to said shaft (1) if the axis of rotation of the intermediate member (4) is staggered in relation to the axis of rotation (5) of the shaft (1). The intermediate member (4) is rotatably supported on an outer eccentric element (40) which is rotatably supported on an eccentric seat (32) of an inner eccentric element (30). The shaft (1) extends through a bore (33) of the inner eccentric element (30), through the outer eccentric element (40) and through the intermediate member (4) and the inner eccentric element (30) has an outer surface (37) concentric with the center line of the bore (33) and arranged in such a way that the outer surface (37) and the bearing (50) lie in a common plane perpendicular to the axis of rotation (5) of the shaft (1).

8 Claims, 9 Drawing Sheets

II–II
2:1

| | |
|---|---|
| CAM SHAFT | 0° |
| INNER ECCENTRIC ELEMENT | 0° |
| OUTER ECCENTRIC ELEMENT | 180° |

*II–II*
*2:1*

| | |
|---|---|
| CAM SHAFT | 90° |
| INNER ECCENTRIC ELEMENT | 0° |
| OUTER ECCENTRIC ELEMENT | 180° |

*II–II*
*2:1*

| | |
|---|---|
| CAM SHAFT | 180° |
| INNER ECCENTRIC ELEMENT | 0° |
| OUTER ECCENTRIC ELEMENT | 180° |

II–II
2:1

| | |
|---|---|
| CAM SHAFT | 270° |
| INNER ECCENTRIC ELEMENT | 0° |
| OUTER ECCENTRIC ELEMENT | 180° |

III–III
2:1

| | |
|---|---|
| CAM SHAFT | 0° |
| INNER ECCENTRIC ELEMENT | 0° |
| OUTER ECCENTRIC ELEMENT | 0° |

III–III
2:1

| | |
|---|---|
| CAM SHAFT | 45° |
| INNER ECCENTRIC ELEMENT | 0° |
| OUTER ECCENTRIC ELEMENT | 0° |

*III–III*
*2:1*

| | |
|---|---|
| CAM SHAFT | 90° |
| INNER ECCENTRIC ELEMENT | 0° |
| OUTER ECCENTRIC ELEMENT | 0° |

*III–III*
*2:1*

| | |
|---|---|
| CAM SHAFT | 135° |
| INNER ECCENTRIC ELEMENT | 0° |
| OUTER ECCENTRIC ELEMENT | 0° |

III–III
2:1

| CAM SHAFT | 180° |
|---|---|
| INNER ECCENTRIC ELEMENT | 0° |
| OUTER ECCENTRIC ELEMENT | 0° |

III–III
2:1

| CAM SHAFT | 225° |
|---|---|
| INNER ECCENTRIC ELEMENT | 0° |
| OUTER ECCENTRIC ELEMENT | 0° |

III–III
2:1

| CAM SHAFT | 270° |
|---|---|
| INNER ECCENTRIC ELEMENT | 0° |
| OUTER ECCENTRIC ELEMENT | 0° |

III–III
2:1

| CAM SHAFT | 315° |
|---|---|
| INNER ECCENTRIC ELEMENT | 0° |
| OUTER ECCENTRIC ELEMENT | 0° |

INTERNAL COMBUSTION ENGINE

BACKGROUND OF THE INVENTION

The present invention relates to an internal combustion engine having a device for cyclically varying the speed of rotation of a cam for gas exchange control.

It is known in the state of the art to drive a cam for controlling an inlet or exhaust valve of an internal combustion engine by a rotary drive mechanism which causes the speed of rotation of a cam to vary in a cyclic manner about an average speed of rotation at a constant number of revolutions of the internal combustion engine. During each complete rotation of the cam a temporary increase of the angular velocity and a temporary decrease of the angular velocity occurs. The average angular velocity of the cam resulting thereof corresponds to the angular velocity of a cam of an internal combustion engine without cyclic variation of the angular velocity.

If the variation of the angular velocity of the cam is effected such that the increase of the speed of rotation of the cam occurs at a time during one rotation of said cam in which said cam operates the valve, the effective duration of opening of said valve is reduced. On the other hand, if the decrease of the speed of rotation occurs at a time of the rotation of said cam in which it operates the valve, a longer duration of opening of said valve is effected. By means of such mechanism it is possible to provide a variable timing of the opening of the valves of the internal combustion engine.

Such rotary drive mechanism is disclosed in the German patent application 195 01 172.4 which does not constitute a prior disclosure. The content of this prior German patent application shall be contained in the present application. In this internal combustion engine the cyclic variation of the speed of rotation of the cam is effected by a rotary drive mechanism comprising a first rotary body being disposed on a shaft and being fixed on said shaft so that it cannot rotate with respect to that shaft, a second rotary body being rotatably supported on said first rotary body and an intermediate member being rotatably supported in a plane perpendicular to the axis of rotation of said shaft and having a first sliding guide and a second sliding guide.

The rotation of the first rotary body is transmitted to the intermediate member by a first transmission element and said first sliding guide and from said intermediate member via the second sliding guide and a second transmission element to the second rotary body. If the intermediate member takes a position in which its axis of rotation is shifted with respect to the axis of rotation of the shaft so that it is not aligned with the latter, the second rotary body is cyclically rotated with respect to the first rotary body at one rotation of the shaft.

With a rotary drive mechanism of that kind either the rotation of the second rotary body can be transmitted to a cam for gas exchange control of an internal combustion engine, for instance by engaging gears, wherein in such case the cam is supported on a separate cam shaft, or the shaft can be formed as the cam shaft and the second rotary body as a cam for gas exchange control of an internal combustion engine.

In both cases there is provided an actuating member for supporting and shifting the intermediate member which supporting member partially accommodates the intermediate member from its outer side wherein said intermediate member with its circular outer circumferential surface is rotatably supported in a corresponding circular inner circumferential surface of the actuating member. The shifting of the actuating member and, accordingly, the intermediate member is effected via two eccentric elements which are engaged with the actuating member in a position outside the circular inner circumferential surface for supporting the intermediate member.

JP 5-118 208 A discloses a device for cyclically varying the speed of rotation of a cam for gas exchange control in which an intermediate ring serving to transmit the rotary motion is supported on a double eccentric assembly.

SUMMARY OF THE INVENTION

The object of the invention is to provide an internal combustion engine having a device for cyclically varying the speed of rotation of a cam for gas exchange control in which the components effecting the variation of the speed of rotation are particularly stiff in order to ensure a precise control and can be designed to be compact so that only little space is needed, wherein particularly a compact and stiff support of the rotating components shall be achieved.

The internal combustion engine according to the present invention comprises a shaft adapted to be rotated about its axis of rotation and a rotary body rotatably supported on said shaft. An intermediate member which is rotatably supported in a plane perpendicular to the axis of rotation of the shaft comprises a first sliding guide and a second sliding guide. The rotation of the shaft can be transmitted via a first transmission element and the first sliding guide to the intermediate member and the rotation of the intermediate member effected by this can be transmitted to the rotary body via the second sliding guide and a second transmission element.

If the intermediate member takes a position in which its axis of rotation is coincident with the axis of rotation of the shaft, the rotary body rotates in synchronism with the shaft. If the intermediate member takes a position in which its axis of rotation has an offset with respect to the shaft, the rotating body is cyclically rotated with respect to the shaft at one rotation of the shaft.

The rotary body itself can be formed as a cam, wherein the shaft in that case is the cam shaft.

The intermediate member is rotatably supported on an outer eccentric element which is rotatably supported on an eccentric seat of an inner eccentric element so that the intermediate member by respective rotation of the inner eccentric element and the outer eccentric element can be shifted in a plane perpendicular to the axis of rotation. The cam shaft extends through a bore of the inner eccentric element, through the outer eccentric element and through the intermediate member.

If the eccentricities of both eccentric elements are selected appropriately, the intermediate member can take any position in the plane perpendicular to the axis of rotation of the cam shaft. Due to this, the timing and the duration of opening of the valves are adjustable and variable at will.

Moreover, it is possible to design the entire mechanism for adjusting smaller than the outer contour of the cam. This means that the adjusting mechanism does not need any additional space in the cylinder head and, accordingly, additional space is only needed for providing the control means necessary to effect the rotation of the eccentric elements.

The inner eccentric element has an outer surface being concentric to a central axis of its bore and is disposed such that this outer surface and a bearing of the cam shaft lie in a common plane perpendicular to the axis of rotation of the cam shaft. Thus, the cam shaft is supported in the inner eccentric element and the inner eccentric element is rotatably fixed by said bearing.

The relative speed of rotation between the inner eccentric element and the cam shaft corresponds to that of a conventional internal combustion engine without a cyclic rotation of the cam. The relative speed of rotation between the inner eccentric element and the bearing is rather low and can be neglected as far as possible frictional losses are concerned. Accordingly, this advantageous configuration provides that no additional bearing facing a high relative speed of rotation is needed as compared with a conventional internal combustion engine without cyclic rotation of the cam so that the overall frictional losses can be kept low. Further, an extremely compact configuration is obtained.

The inner eccentric element can comprise an inner eccentric gear ring which is disposed on one side of the bearing and the outer eccentric element can comprise an outer eccentric gear ring which is disposed on the other side of the bearing. The gear rings are connected with the eccentric elements, respectively, so that the eccentric elements can be rotated via said gear rings by respective control means (step motors, lever devices operated by hydraulic shifting elements etc.).

BRIEF DESCRIPTION OF THE DRAWINGS

Further features and advantages of the invention will be apparent from the following description of preferred embodiments in connection with the accompanied drawing in which.

DESCRIPTION OF THE PREFERRED EMBODIMENT

Figure 1A:
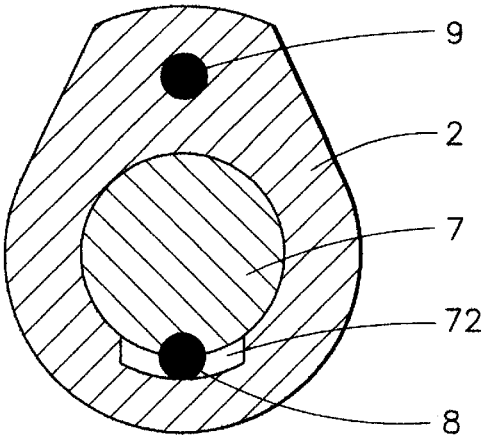
FIG. 1A is an end sectional view along line I—I of FIG. 1.
Figure 1:
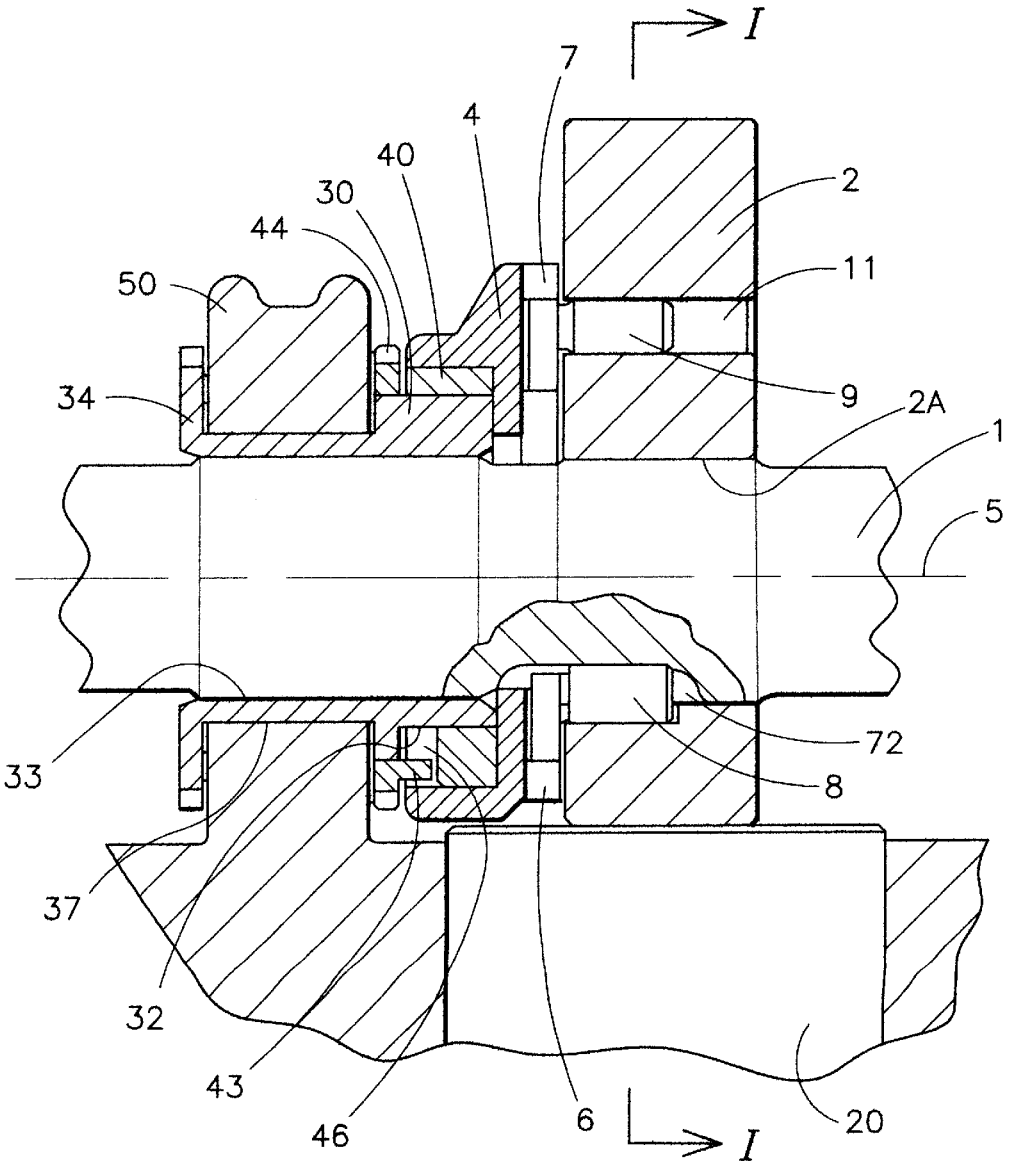
FIG. 1 is a sectional view of an embodiment of a device for cyclically varying the speed of rotation of a cam.

In the embodiment shown in FIG. 1 a device for cyclically varying the speed of rotation of a cam for gas exchange control in an internal combustion engine according to the present invention comprises a cam 2 disposed on a cam shaft 1 having an axis of rotation 5. The cam 2 can be rotated with respect to the cam shaft 1. The cam 2 can be supported directly on said cam shaft 1 or certain bearing means (not shown) can be provided between cam 2 and cam shaft 1.

An inner eccentric element 30 is also rotatably disposed on the cam shaft, said inner eccentric element 30 having an eccentric seat 32 on which an outer eccentric element 40 is rotatably supported. Thus, the cam shaft 1 extends through a bore 2A of cam 2, through the outer eccentric element 40 and through a bore 33 of inner eccentric element 30.

The bore 33 of inner eccentric element 30 provides a bearing for the cam shaft 1 so that the cam shaft 1 can rotate in the inner eccentric element 30 about its axis of rotation 5. The inner eccentric element 30 is rotatably held by a bearing 50. An inner eccentric gear ring 34 is shown on the left hand side of the bearing 50 in FIG. 1. The inner eccentric gear ring 34 is securely fixed to the inner eccentric element 30 so that it cannot be rotated with respect to the inner eccentric element 30. On the right hand side of the bearing 50 in FIG. 1 an outer eccentric gear ring 44 is rotatably supported on the inner eccentric element 30 so that the outer eccentric gearing 44 is concentrical to the cam shaft 1. The outer eccentric gear ring 44 has a projection 43 which engages a radial groove 46 of the outer eccentric element 40, the outer eccentric element 40 being rotatably supported on the eccentric seat 32 of the inner eccentric element 30.

An intermediate member 4 is rotatably supported on the outer eccentric element 40. This intermediate member 4 has a first radial sliding guide 6 and a second radial sliding guide 7.

As shown in FIG. 1 and FIG. 1A, cam shaft 1 has a groove 72 in which a first transmission element 8 is inserted. The groove 72 in the cam 2 has a width in the circumferential direction sufficiently wide to allow rotational movement of the cam 2 with respect to the cam shaft 1. The cam 2 has a bore 11 in which a second transmission element 9 is inserted. The transmission element has an L-form wherein a first portion extending parallel to the axis of rotation 5 of the cam shaft 1 has a circular cross section in order to allow a rotary motion of the transmission element 8, 9 in the groove 72 and the bore 11, respectively, and a second portion which substantially extends perpendicular to the first portion has flat sides in order to insure a planar engagement of the transmission element 8, 9 with the first sliding guide 6 and the second sliding guide 7, respectively, of the intermediate member 4.

When the cam shaft 1 rotates about its axis of rotation 5, this rotation is transmitted via the first transmission element 8 and the first sliding guide 6 to the intermediate member 4. The rotation of the intermediate member 4 effected by this is transmitted via the second sliding guide 7 and the second transmission element 9 to the cam 2. When the excentricity of the inner eccentric element 30 and the excentricity of the outer eccentric element 40 are equal with respect to their dimensions and both eccentric elements 30, 40 have a mutual angular position with respect to each other that their eccentricities are opposite to each other, the intermediate member 4 is in a position in which its axis of rotation coincides with the axis of rotation 5 of the cam shaft 1. In this position, the cam 2 rotates in synchronism with the cam shaft 1.

If, starting from this position, the inner eccentric element 30 via the inner eccentric gear ring 34 and/or the outer eccentric element 40 via the outer eccentric gear ring 44 is rotated, the intermediate member 4 takes a position in which its axis of rotation is shifted with respect to the axis of rotation 5 of the cam shaft 1 so that there is an offset. Due to this, the speed of rotation of the cam shaft 2 is cyclically varied with respect to the cam shaft 1. Depending on the position of the cam 2 and the shifting direction of the intermediate member 4 a valve (not shown) operated via a tappet 20 can be opened for a longer or shorter duration as compared with a case where the cam 2 rotates with a constant speed of rotation.

Figure 2:
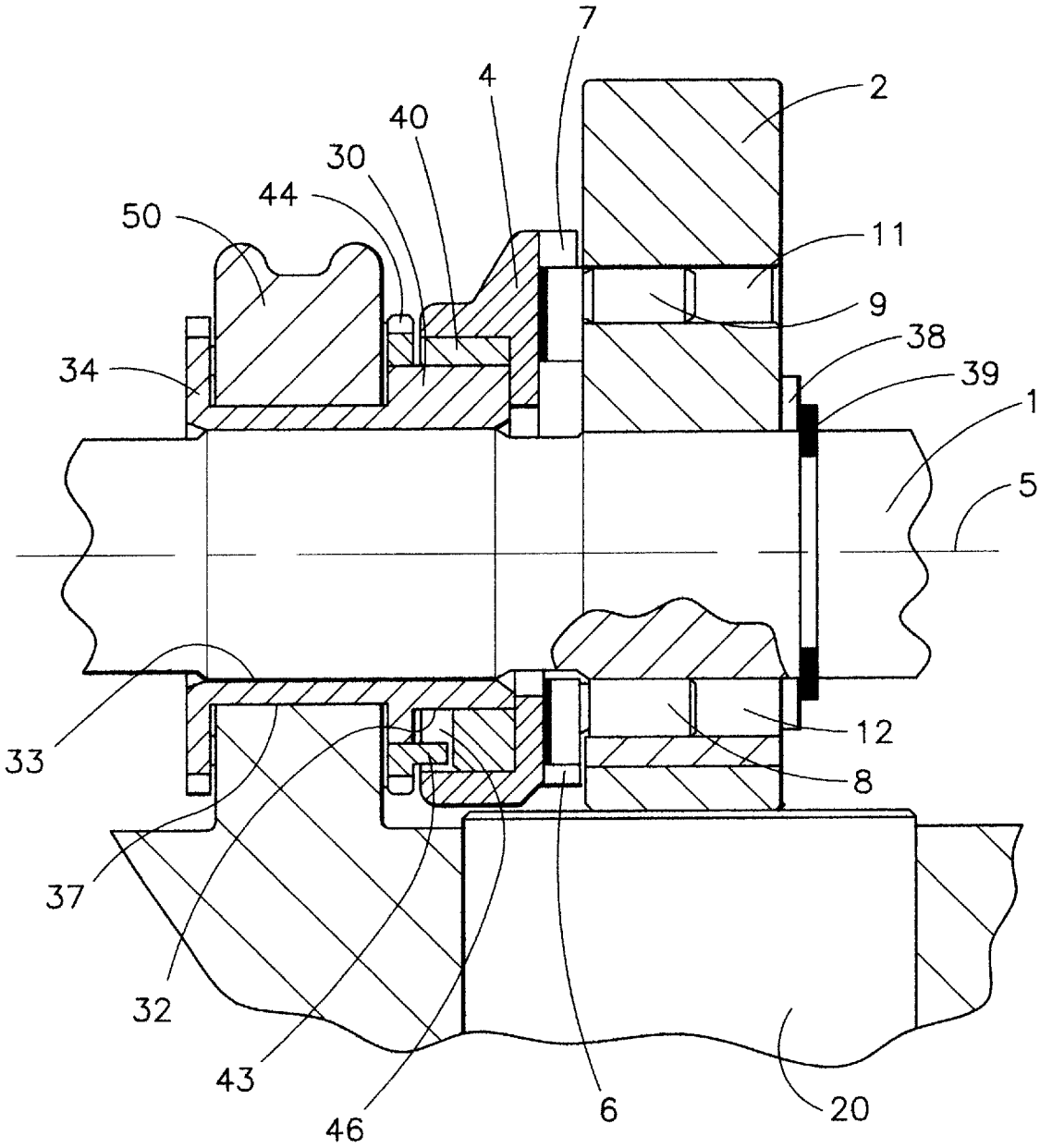
FIG. 2 is a depiction corresponding to FIG. 1 showing a fixing of the cam in an axial direction.

FIG. 2 shows a possibility for securing the cam 2 in an axial direction. For this purpose a stop ring 38 is provided on the cam shaft 1. The stop ring 38 is fixed by a snap ring 39. Since the inner eccentric element 30 is fixed by the bearing 50 in a radial and an axial direction, the stop ring 38, the cam 2, the intermediate member 4, the outer eccentric element 40 and the outer eccentric gear ring 44 are fixed in an axial direction between the snap ring 39 and the bearing 50.

When the axis of rotation of the intermediate element 4 coincides with the axis of rotation of shaft 1, no variation of the speed of rotation of cam 2 is induced. However, when the intermediate element 4 is in an offset position with respect to shaft 1, the center of rotation of the intermediate element 4 is in an offset position to the center of rotation of the first and second transmission elements 8 and 9. Thus, the effective length or lever arm between the first transmission element 8 and the intermediate element 4 and between the intermediate member 4 and the second transmission element 9 vary over one rotation of shaft 1 and, because of such varying lever arm transmitting the rotation, the speed of the rotation is varied.

Figure 3:
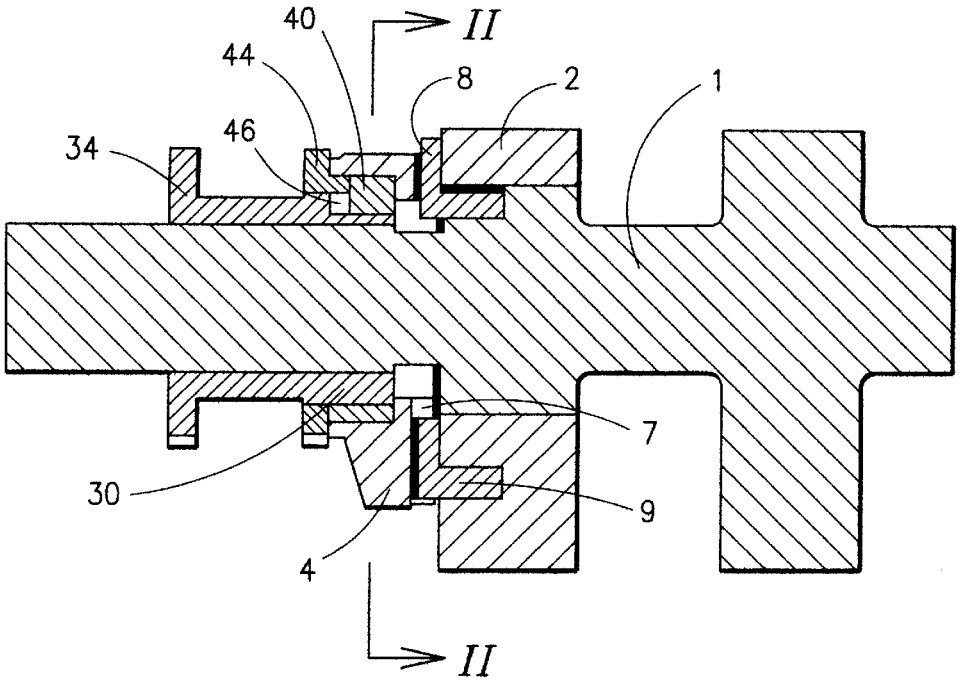
FIG. 3 is a sectional view of a further embodiment of a device for cyclically varying the speed of rotation of a cam generally corresponding to the depiction shown in FIG. 1 where additionally a reference cam is rigidly fixed on the cam shaft and the axis of rotation of the intermediate member 4 coincides with the axis of rotation of the cam shaft and the rotational angle of the cam shaft is defined to be 0°.

FIG. 3 basically corresponds to FIG. 1. For the sake of simplicity, the bearing 50 and the toppet 20 of FIG. 1 are omitted. As a further difference to FIG. 1, FIG. 3 additionally contains a reference cam 101 which is rigidly fixed on the cam shaft 1.

Like FIG. 1, FIG. 3 shows an intermediate member 4 which is rotatably supported on an outer eccentric element 40. The outer eccentric element 40 is rotatably supported on an inner eccentric element 30. A cam shaft 1 extends through the intermediate member 4, the outer eccentric element 40 and the inner eccentric element 30. The position of the intermediate member 4 can be varied with respect to the position of the cam shaft 1 by rotating the outer eccentric element 40 and the inner eccentric element 30. The rotation of the outer eccentric element 40 is effected via an outer eccentric gearing 46. The rotation of the inner eccentric element 30 is effected via an inner eccentric gearing 34.

A cam 2 is rotatably supported on the cam shaft 1. The cam shaft 1 is operationally connected to the intermediate member 4 by a first transmission element 8. The first transmission element 8 can pivot with respect to the cam shaft 1 and is slidably received in a first sliding guide provided in the intermediate member 4.

The intermediate member 4 is operationally connected to the cam 2 via a second transmission element 9. The second transmission element 9 can pivot with respect to the cam 2 and is slidably received in a second sliding guide 7 provided in the intermediate member 4.

Although the embodiment shown in FIG. 3 corresponds to that shown in FIG. 1, in addition, the embodiment shown in FIG. 3 includes a reference cam which is rigidly fixed on the cam shaft 1.

FIGS. 3 to 7 show the assembly just described in a state where the axis of rotation of the intermediate member 4 coincides with the axis of rotation of the cam shaft 1. This positional relationship between the intermediate member 4 and the cam shaft 1 is provided by respective positions of the inner eccentric element 30 having a rotational angle of 0° and the outer eccentric element 40 having a rotational angle of 180° so both eccentricities neutralize each other.

Figure 4:
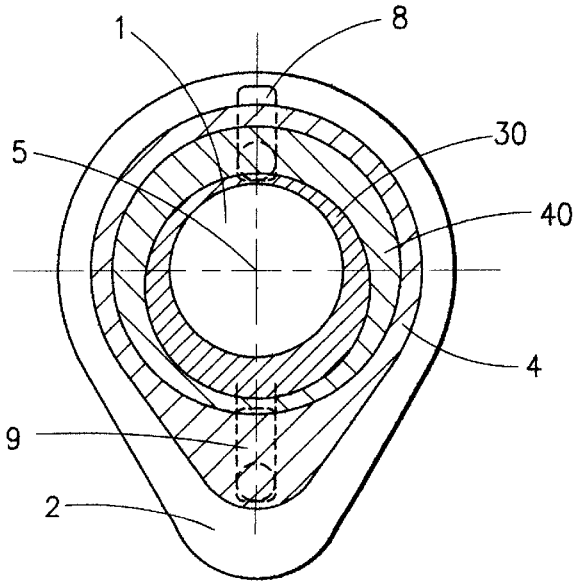
FIG. 4 is a sectional view along line II—II of FIG. 3 in an enlarged scale.
Figure 5:
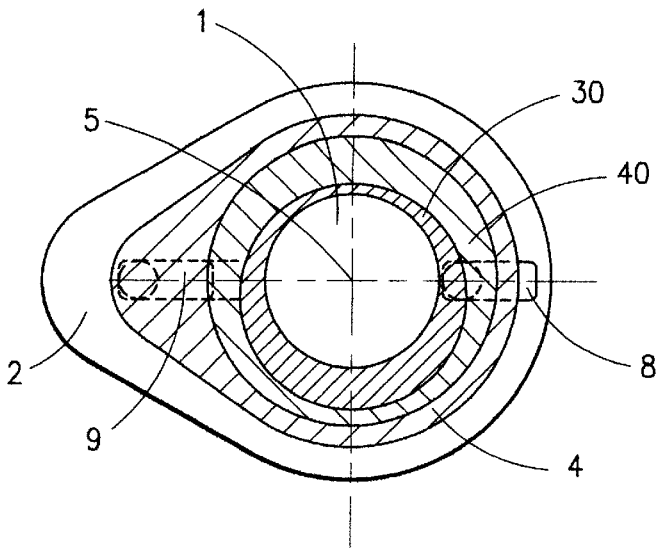
FIG. 5 is a sectional view like FIG. 4 where the rotational angle of the cam shaft is 90°.
Figure 6:
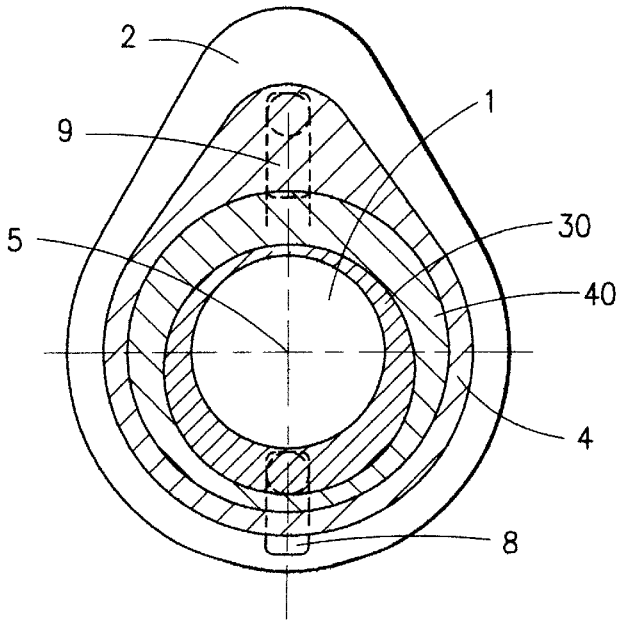
FIG. 6 is a sectional view like FIG. 4 where the rotational angle of the cam shaft is 180°.
Figure 7:
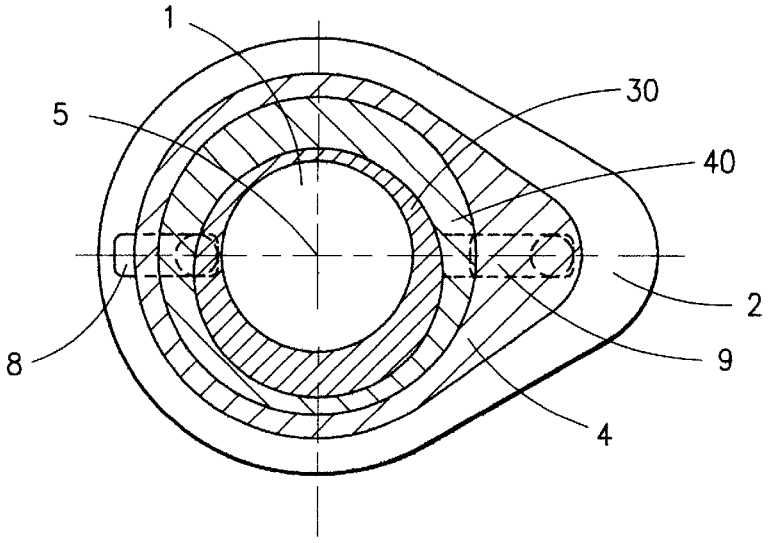
FIG. 7 is a sectional view like FIG. 4 where the rotational angle of the cam shaft is 270°.
Figure 8:
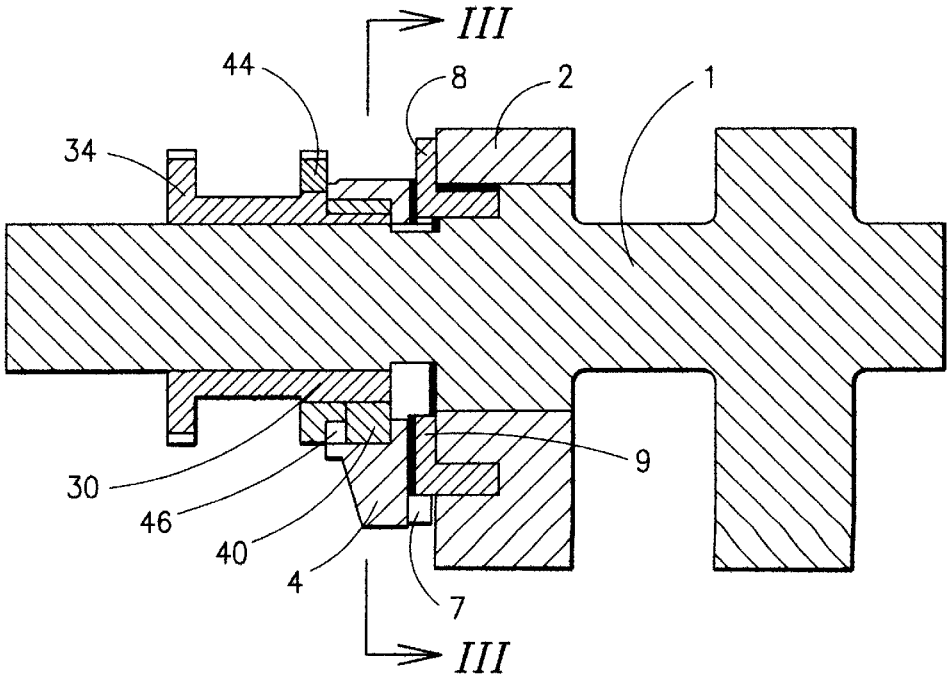
FIG. 8 is a sectional view like FIG. 3 where the axis of rotation of the intermediate member is in an offset position with respect to the axis of rotation of the cam shaft.

The sectional view depicted in FIG. 4 shows that at the beginning of the rotation of the cam shaft (rotational angle= 0°) the reference cam and the cam 2 have the same angular position. As shown in FIGS. 5 to 7, during one complete rotation of the cam shaft 1 the cam 2 and the reference cam 101 have the same angular position with respect to each other since the axis of rotation of the intermediate member 4 coincides with the axis of rotation of the cam shaft 1.

FIGS. 8 to 16 show the assembly as described above in a state where the axis of rotation of the intermediate member 4 is in an offset position with respect to the axis of rotation 5 of the cam shaft 1. This offset position is effected by bringing the outer eccentric element in a position (rotational angle=0°) where its eccentricity extends in the same direction as the eccentricity of the inner eccentric element 30. In FIGS. 8 to 16, the axis of rotation of the intermediate member 4 lies below the axis of rotation 5 of the cam shaft 1.

FIGS. 9 to 16 show the positions of the respective elements at eight different rotational angles of the cam shaft 1 during a rotation of the cam shaft 1 in a clockwise direction, namely at the rotational angles of the cam shaft being 0°, 45°, 90°, 135°, 180°, 225°, 270°, and 315°, respectively.

Figure 9:
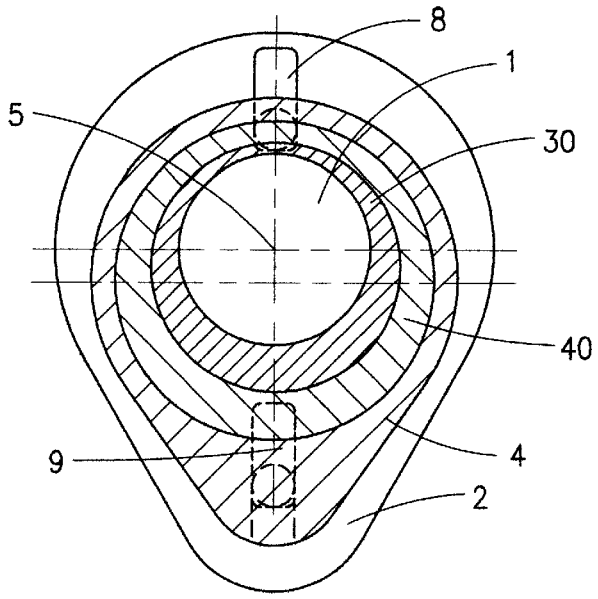
FIG. 9 is a sectional view along line III—III of FIG. 8 in an enlarged scale.
Figure 10:
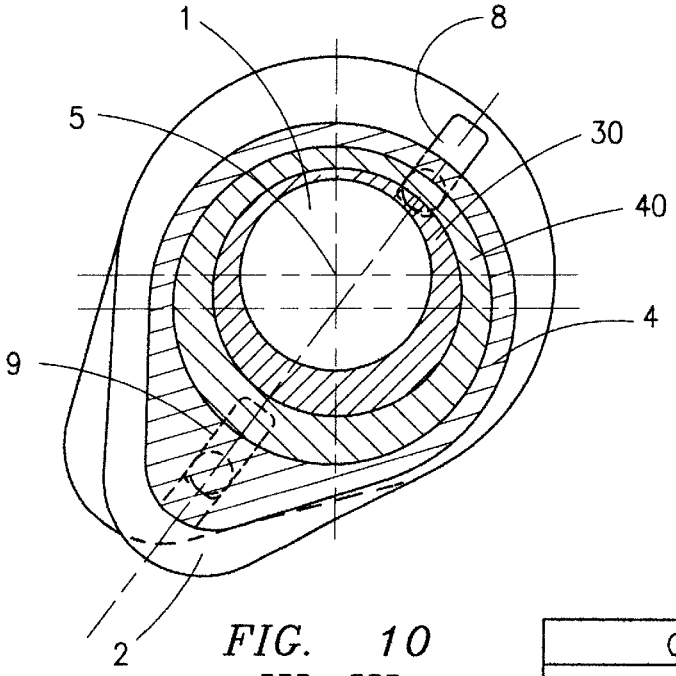
FIG. 10 is a sectional view like FIG. 9 where the rotational angle of the cam shaft is 45°.
Figure 11:
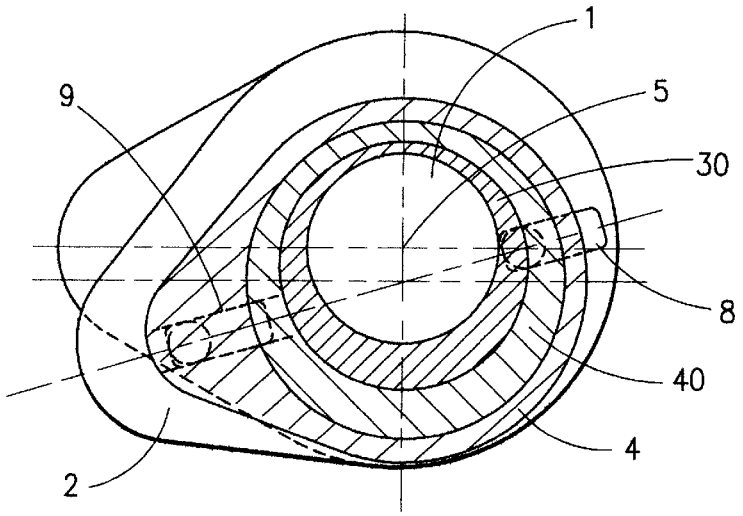
FIG. 11 is a sectional view like FIG. 9 where the rotational angle of the cam shaft is 90°.
Figure 12:
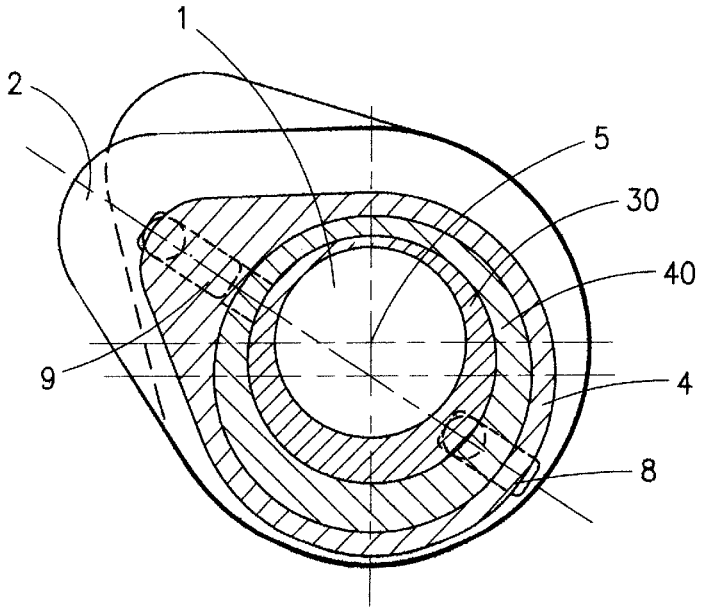
FIG. 12 is a sectional view like FIG. 9 where the rotational angle of the cam shaft is 135°.
Figure 13:
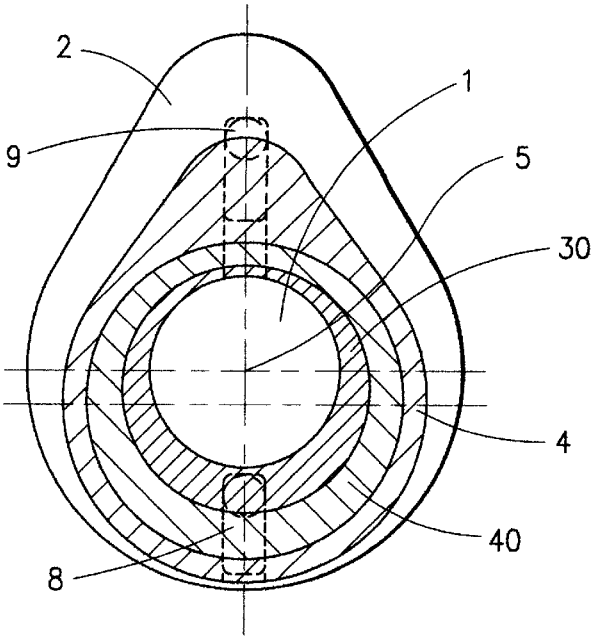
FIG. 13 is a sectional view like FIG. 9 where the rotational angle of the cam shaft is 180°.
Figure 14:
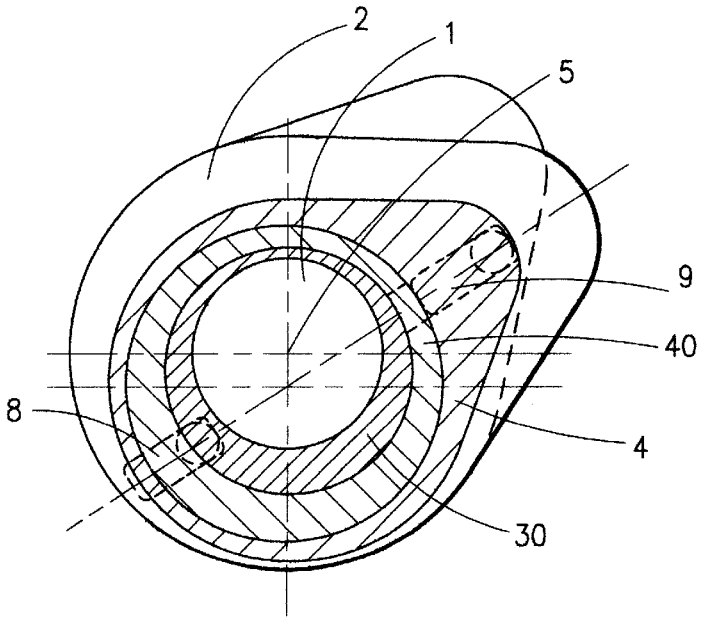
FIG. 14 is a sectional view like FIG. 9 where the rotational angle of the cam shaft is 225°.

FIG. 9 shows the initial state in which the cam 2 and the reference cam 101 have the same angular position. If the cam shaft 1 is rotated in a clockwise direction, the cam 2 at first rotates slower than the reference cam 101 so that at a rotational angle of 90° of the cam shaft there is a maximum difference between the angular position of the reference cam being ahead and cam 2 being delayed.

During further rotation of the cam shaft 1 in a clockwise direction the cam 2 rotates faster than the cam shaft 1 and the reference cam 101 rigidly fixed thereto so that the cam 2 catches up again with the reference cam 101. At a rotational angle of the cam shaft of 180° (FIG. 13) cam 2 and the reference cam again have the same angular position.

Figure 15:
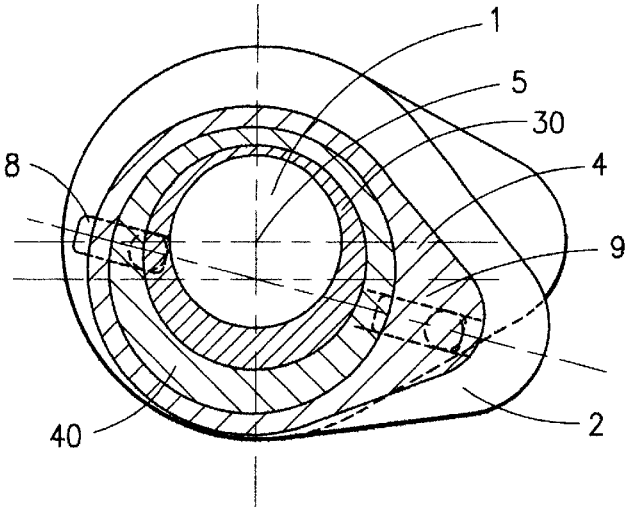
FIG. 15 is a sectional view like FIG. 9 where the rotational angle of the cam shaft is 170°.
Figure 16:
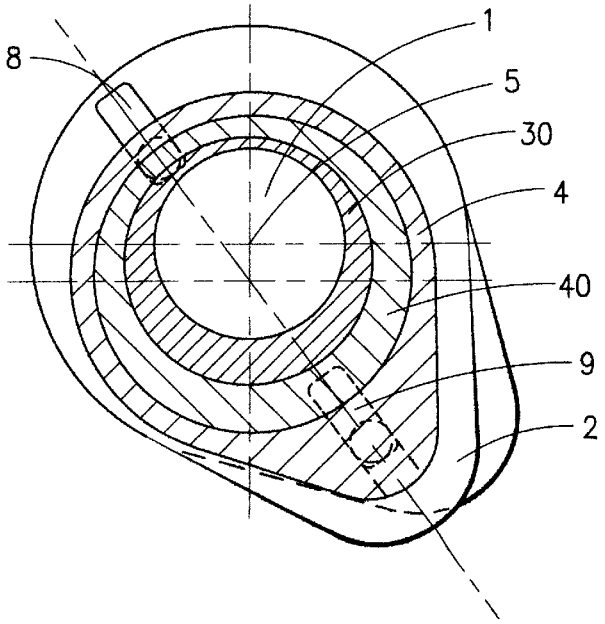
FIG. 16 is a sectional view like FIG. 9 where the rotational angle of the cam shaft is 315°.

During further rotation of the cam shaft in a clockwise direction the cam 2 continues to rotate faster than the reference cam. The angular difference has its maximum value at a rotational angle of the cam shaft of 270° (FIG. 15).

During the last quarter of one complete revolution of the cam shaft 1 the cam 2 again rotates slower than the reference cam so that at a rotational angle of the cam shaft 1 of 360° corresponding to 0° (FIG. 9) the cam 2 again has the same angular position as the reference cam.

The cyclically rotation of the cam 2 with respect to the cam shaft 1 is caused by the intermediate member 4 being in an offset position with respect to the cam shaft 1 so that the radii under which the operational connection between the cam shaft 1 and the intermediate member 4 via the first transmission element 8 on the one hand and the operational connection between the intermediate member 4 and the cam 2 via the second transmission element 9 on the other hand is effected vary continuously. The variation of these radii is possible due to the fact that both transmission elements 8 and 9 are adapted to pivot with respect to the cam shaft 1 and the cam 2, respectively, and are adapted to move in their respective sliding guides.

We claim:

1. An internal combustion engine having a device for cyclically varying the speed of rotation of a cam for gas exchange control comprising:

a shaft having an axis of rotation;

a rotary body being rotatably supported on said shaft, wherein the speed of rotation of the rotary body corresponds to the speed of rotation of said cam;

an intermediate member rotatably supported in a plane perpendicular to said axis of rotation of said shaft and comprising a first sliding guide and a second sliding guide;

a first transmission element operatively connecting said shaft with said first sliding guide for transmission of the rotation of said shaft to said intermediate member; and a second transmission element operatively connecting said rotary body with said second sliding guide for transmission of the rotation of the intermediate member to said rotary body, so that the rotary body is cyclically rotated with respect to said shaft at one rotation of said shaft if the axis of rotation of said intermediate member is shifted with respect to said axis of rotation of said shaft so that there is an offset of both axes of rotation;

wherein said intermediate member is rotatably supported on an outer eccentric element being rotatably supported on an eccentric seat of an inner eccentric element, so that said intermediate member by rotation of said inner eccentric element and said outer eccentric element can be shifted in a plane perpendicular to said axis of rotation;

wherein said shaft extends through a bore of said inner eccentric element, through said outer eccentric element and through said intermediate member; and wherein the inner eccentric element has an outer surface being concentric with respect to the center line of the bore and disposed such that said outer surface and a bearing of said shaft lie in a common plane perpendicular to said axis of rotation of said shaft, so that said shaft is supported in said inner eccentric element and said inner eccentric element is rotatably held in an axial direction by said bearing.

2. The internal combustion engine as claimed in claim 1, characterized in that said inner eccentric element has an inner eccentric gear ring disposed at one side of said bearing and said outer eccentric element has an outer eccentric gear ring disposed on the other side of said bearing, wherein said eccentric elements are adapted to be rotated via said gear rings by respective control means.

3. The internal combustion engine as claimed in claim 1, characterized in that said rotary body is fixed on said shaft at one side by said intermediate member and said inner eccentric element supported by said bearing and on its other side by a snap ring.

4. The internal combustion engine as claimed in claim 3, characterized in that a stop ring is provided between said rotary body and said snap ring.

5. An internal combustion engine having a device for cyclically varying the speed of rotation of a cam for gas exchange control comprising:

a cam shaft having an axis of rotation;

a cam being rotatably supported on said cam shaft;

an intermediate member rotatably supported in a plane perpendicular to said axis of rotation of said cam shaft and comprising a first sliding guide and a second sliding guide;

a first transmission element operatively connecting said cam shaft with said first sliding guide for transmission of the rotation of said cam shaft to said intermediate member; and a second transmission element operatively connecting said cam with said second sliding guide for transmission of the rotation of the intermediate member to said cam, so that the cam is cyclically rotated with respect to said cam shaft at one rotation of said cam shaft if the axis of rotation of said intermediate member is shifted with respect to said axis of rotation of said cam shaft so that there is an offset of both axes of rotation;

wherein said intermediate member is rotatably supported on an outer eccentric element being rotatably supported on an eccentric seat of an inner eccentric element, so that said intermediate member by rotation of said inner eccentric element and said outer eccentric element can be shifted in a plane perpendicular to said axis of rotation;

wherein said cam shaft extends through a bore of said inner eccentric element, through said outer eccentric element and through said intermediate member; and wherein the inner eccentric element has an outer surface being concentric with respect to the center line of the bore and disposed such that said outer surface and a bearing of said shaft lie in a common plane perpendicular to said axis of rotation of said cam shaft, so that said cam shaft is supported in said inner eccentric element and said inner eccentric element is rotatably held in an axial direction by said bearing.

6. The internal combustion engine as claimed in claim 5, characterized in that said inner eccentric element has an inner eccentric gear ring disposed at one side of said bearing and said outer eccentric element has an outer eccentric gear ring disposed on the other side of said bearing, wherein said eccentric elements are adapted to be rotated via said gear rings by respective control means.

7. The internal combustion engine as claimed in claim 5, characterized in that said cam is fixed on said cam shaft at one side by said intermediate member and said inner eccentric element supported by said bearing and on its other side by a snap ring.

8. The internal combustion engine as claimed in claim 7, characterized in that a stop ring is provided between said cam and said snap ring.

* * * * *